United States Patent [19]

Inoue et al.

[11] 3,939,750

[45] Feb. 24, 1976

[54] ELECTRONIC ORGAN

[75] Inventors: Michihiro Inoue; Takeji Kimura, both of Hirakata; Masaharu Sato, Moriguchi, all of Japan

[73] Assignee: Matsushita Electric Industrial Co., Ltd., Japan

[22] Filed: Mar. 6, 1975

[21] Appl. No.: 555,731

[30] Foreign Application Priority Data

Mar. 6, 1974 Japan ..... 49-25964
Mar. 6, 1974 Japan ..... 49-25965

[52] U.S. Cl. ..... 84/1.22; 84/1.01; 84/1.19; 84/1.11

[51] Int. Cl.[2] ..... G10H 1/06

[58] Field of Search ..... 84/1.01, 1.19, 1.22, 1.21, 84/1.24, 1.26, 1.11

[56] References Cited

UNITED STATES PATENTS

| | | | |
|---|---|---|---|
| 3,440,324 | 4/1969 | Schrecongost et al. | 84/1.01 X |
| 3,534,144 | 10/1970 | Ring | 84/1.22 X |
| 3,636,231 | 1/1972 | Schrecongost et al. | 84/1.26 X |
| 3,746,773 | 7/1973 | Uetrecht | 84/1.01 |
| 3,748,944 | 7/1973 | Schrecongost | 84/1.22 |
| 3,819,844 | 6/1974 | Isii | 84/1.26 |
| 3,821,714 | 6/1974 | Tomisawa et al. | 84/1.01 X |

*Primary Examiner*—L. T. Hix
*Assistant Examiner*—U. Weldon
*Attorney, Agent, or Firm*—Burgess Ryan and Wayne

[57] ABSTRACT

An electronic organ comprises memory means for memorizing in an analog manner the synthesizing ratio of repetitively occuring waves such as square waves for synthesizing qualities of sound in response to the signals from means for selecting qualities of sound (to be referred to as tablets hereinafter); a mixing circuit for adding the synthesizing ratio for each repetitively occuring wave when the means for selecting qualities of sound are selected; frequency dividers for dividing the oscillation frequencies of top octave generators, an indirect keying circuit for interrupting the current corresponding to the ratio of repetitively occuring waves in response to the repetitively occuring signal waveforms from the frequency dividers and intermittingly interrupting said current in response to on-off signals from a keyboard; a synthesizing circuit for combining the outputs from the indirect keying circuit into a group for each octave; a variable filter for changing the frequency characteristics electronically in response to the outputs from said tablets; and detectors of key number and tablet number for detecting the number of keys pressed and the number of tablets selected, respectively, for effecting the additive control of the amplitudes of the output tone signals.

18 Claims, 14 Drawing Figures

| FIG. 2A | FIG. 2B | FIG. 2C |
|---|---|---|

ELECTRONIC ORGAN

BACKGROUND OF THE INVENTION

The present invention relates to an electronic organ.

In generators of sound in the conventional electronic organs, the combination of oscillators and frequency dividers is used to produce the square waves with a fundamental frequency corresponding a key pressed and square waves with a frequency of an integral multiple of the fundamental frequency. These square waves are combined or synthesized in a desired ratio, and the combined or synthesized output is made to pass through a tone filter so that undesired frequency spectrum may be removed. Moreover, in general, the direct keying system is used for intermittently interrupting the square wave trains with the above harmonic series. However, a large number of filters are required in order to determine a desired ratio in which the harmonic components are combined and to produce various timbres, so that the conventional electronic organs are complex in construction and expensive. In order to overcome this problem, there has been proposed a system in which timbres are combined into groups each consisting of a few or several or tens timbres and these timbre groups are made to pass through low-pass filters. However, this system has a defect that the timbres and volume are considerably different at high and low tones. Furthermore, it is difficult to simplify the construction so that the associated circuits may not be fabricated in the form of LSI.

SUMMARY OF THE INVENTION

The present invention has for its object to provide an electronic organ which uses a generator of sound of the type synthesizing the repetitively occuring waves such as square waves, makes it possible to be fabricated in the form of LSI (large scale integration), and is simple in construction.

The fundamental construction of the present invention comprises memory means for memorizing in an analog manner the synthesizing ratio of repetitively occuring waves such as square waves for synthesizing qualities of sound in response to signals from a means for selecting qualities of sound (to be referred to as tablets hereinafter); a mixing circuit for adding the synthesizing ratio for each repetitively occuring wave when the means for selecting qualities of sound are selected; frequency dividers for dividing the oscillation frequencies of top octave generators, an indirect keying circuit for interrupting the current corresponding to the ratio of repetitively occuring waves in response to the repetitively occuring signal waveforms from the frequency dividers and intermittently interrupting said current in response to on-off signals from a keyboard; a synthesizing circuit for combining the outputs from the indirect keying circuit into a group for each octave; a variable filter for changing the frequency characteristics electronically in response to the outputs from said tablets; and detectors of key number and tablet number for detecting the number of keys pressed and the number of tablets selected, respectively, for effecting the additive control of the amplitudes of the output tone signals.

The present invention may attain the following features and advantages:

1. The stage for synthesizing the repetitively occuring waves such as square waves is made up of transistors such as MOS-FETs; the means for controlling qualities of sound for determining the ratio specific to a selected tablet is made up of resistor arrays; and operational amplifiers are used. Therefore, they are fabricated in the form of LSI, and the construction is simple.

2. The repetitive occuring waves such as square waves in each order from the keying circuit are added by the operational amplifiers so that the additive control is facilitated.

3. The characteristic of the variable filter is electronically selected in response to selected tablets so that a large number of qualities of sound may be produced by a relatively small number of filters.

4. The sound quality may be improved over the conventional electronic organs.

BREIF DESCRIPTION OF THE DRAWINGS

DESCRIPTION OF THE PREFERRED EMBODIMENTS

Figure 1:
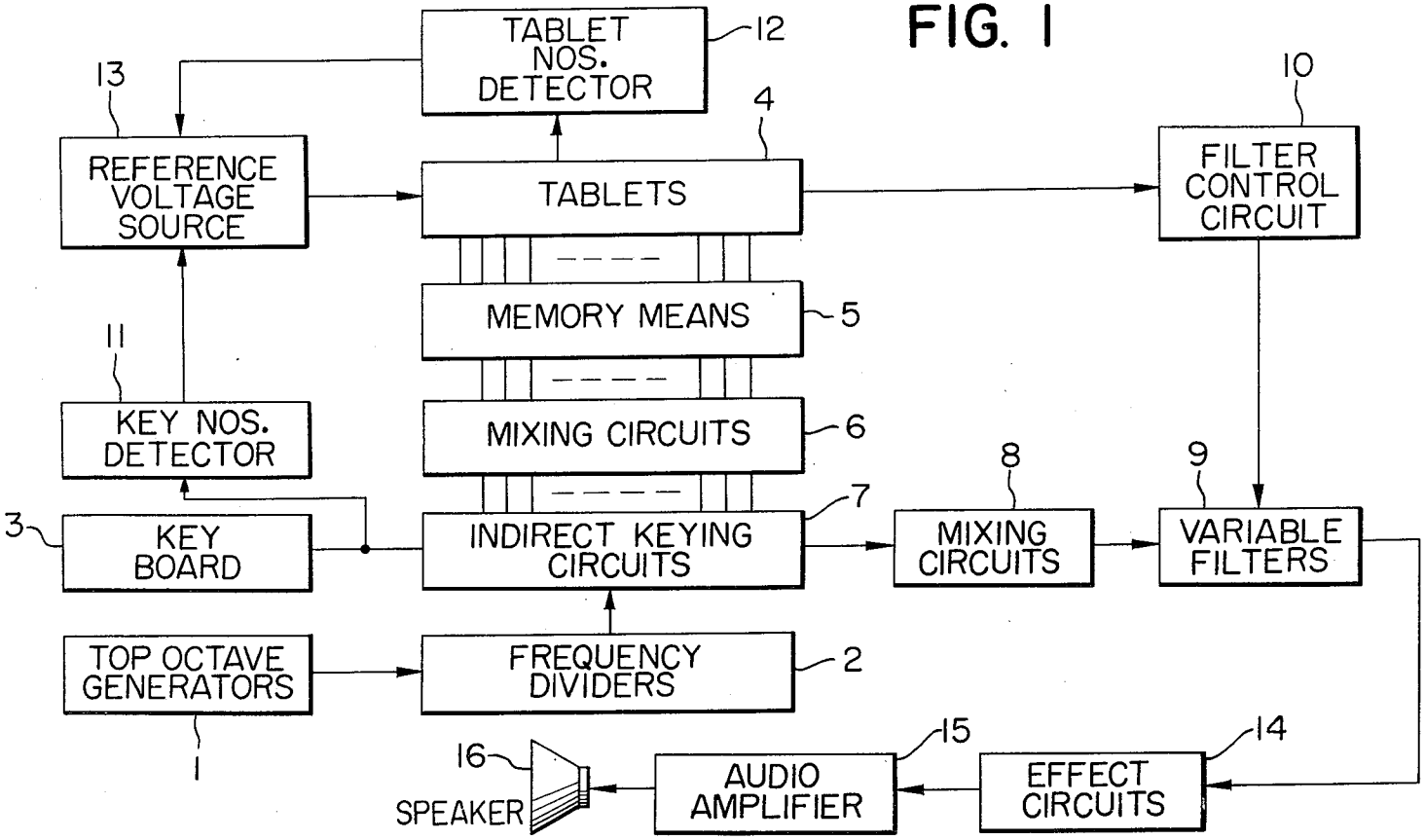
FIG. 1 is a simplified block diagram illustrating the fundamental construction of the preferred embodiments of the present invention.
Figures 2, 2C:
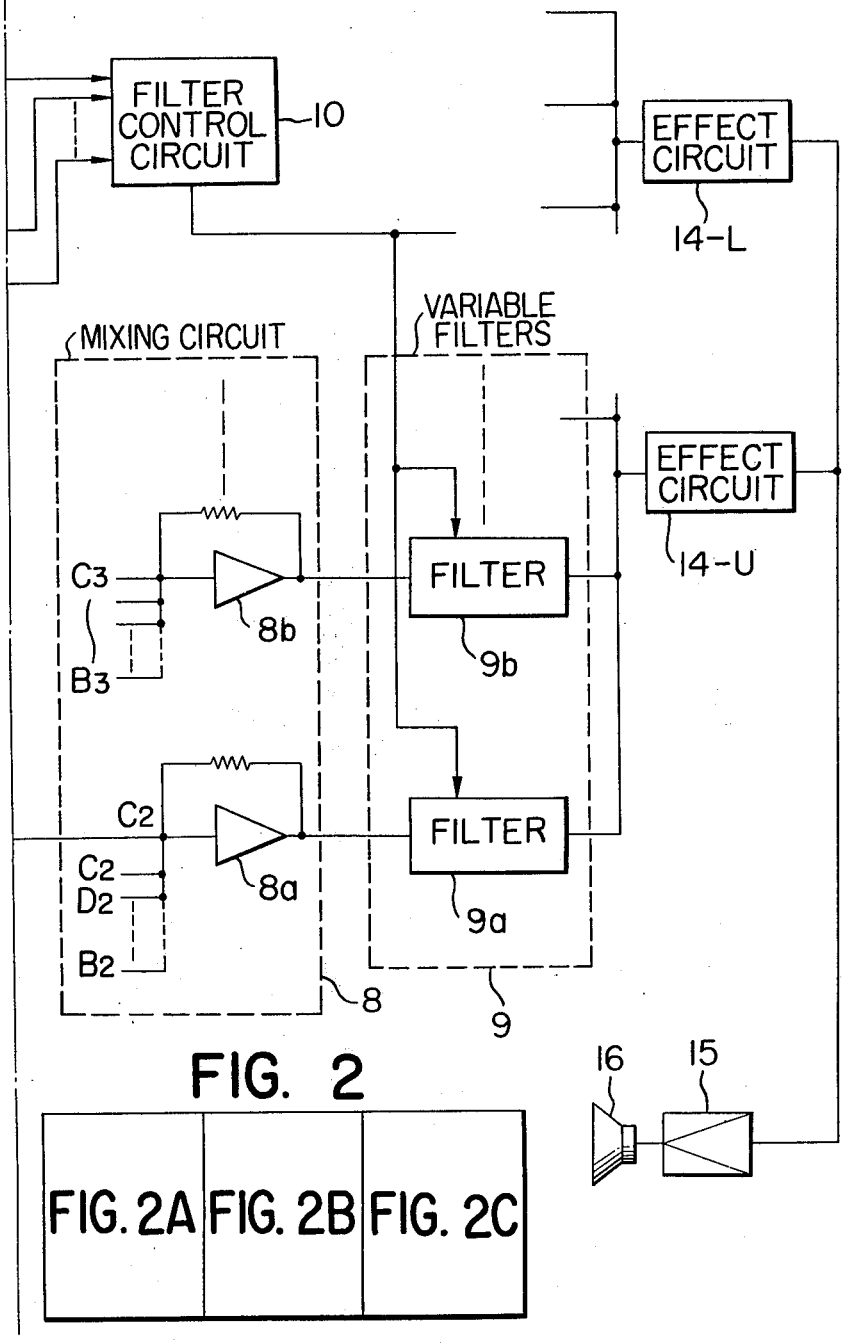
FIG. 2 is a circuit diagram illustrating major components thereof.
Figure 2A:
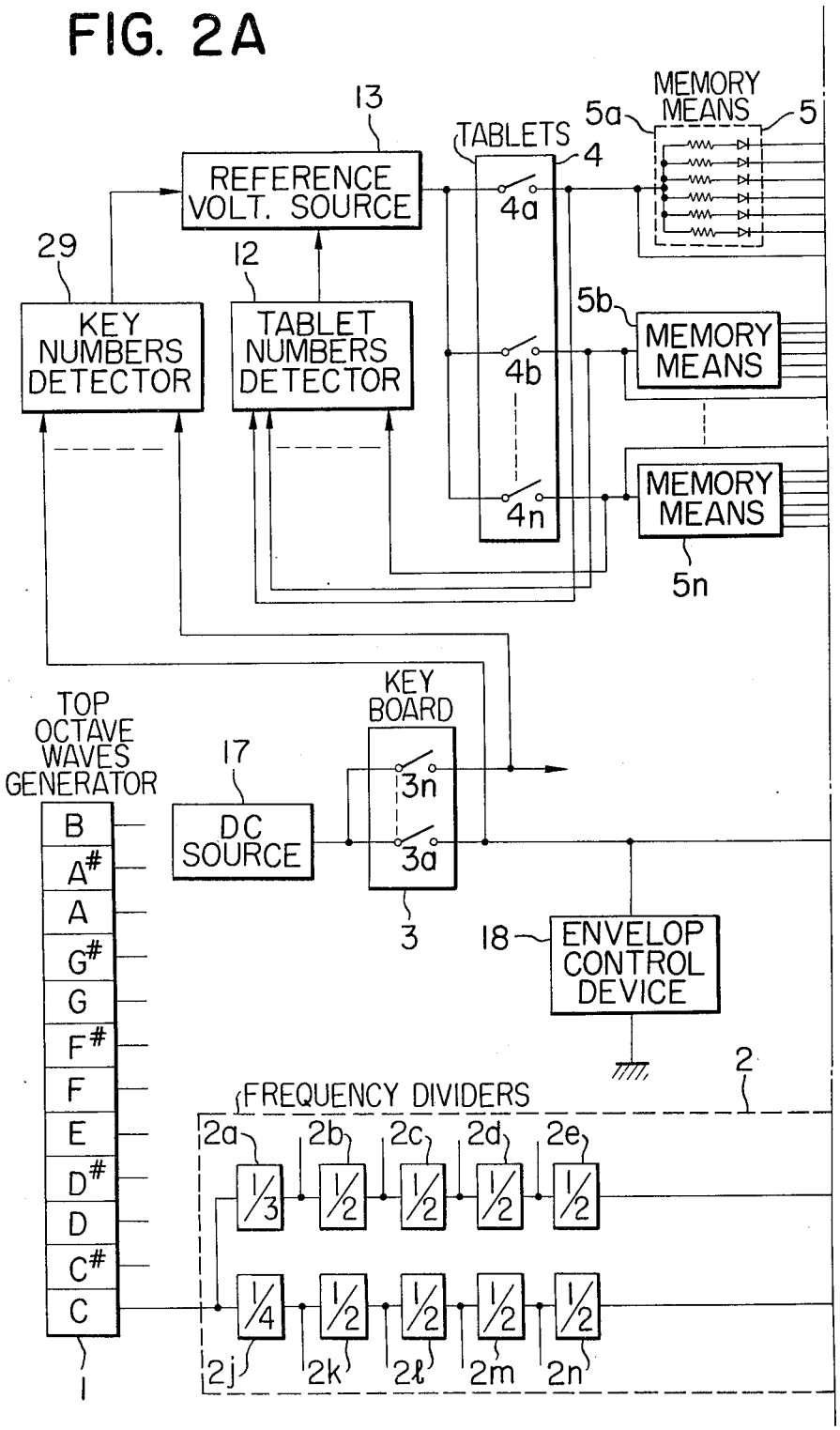
Figure 2B:
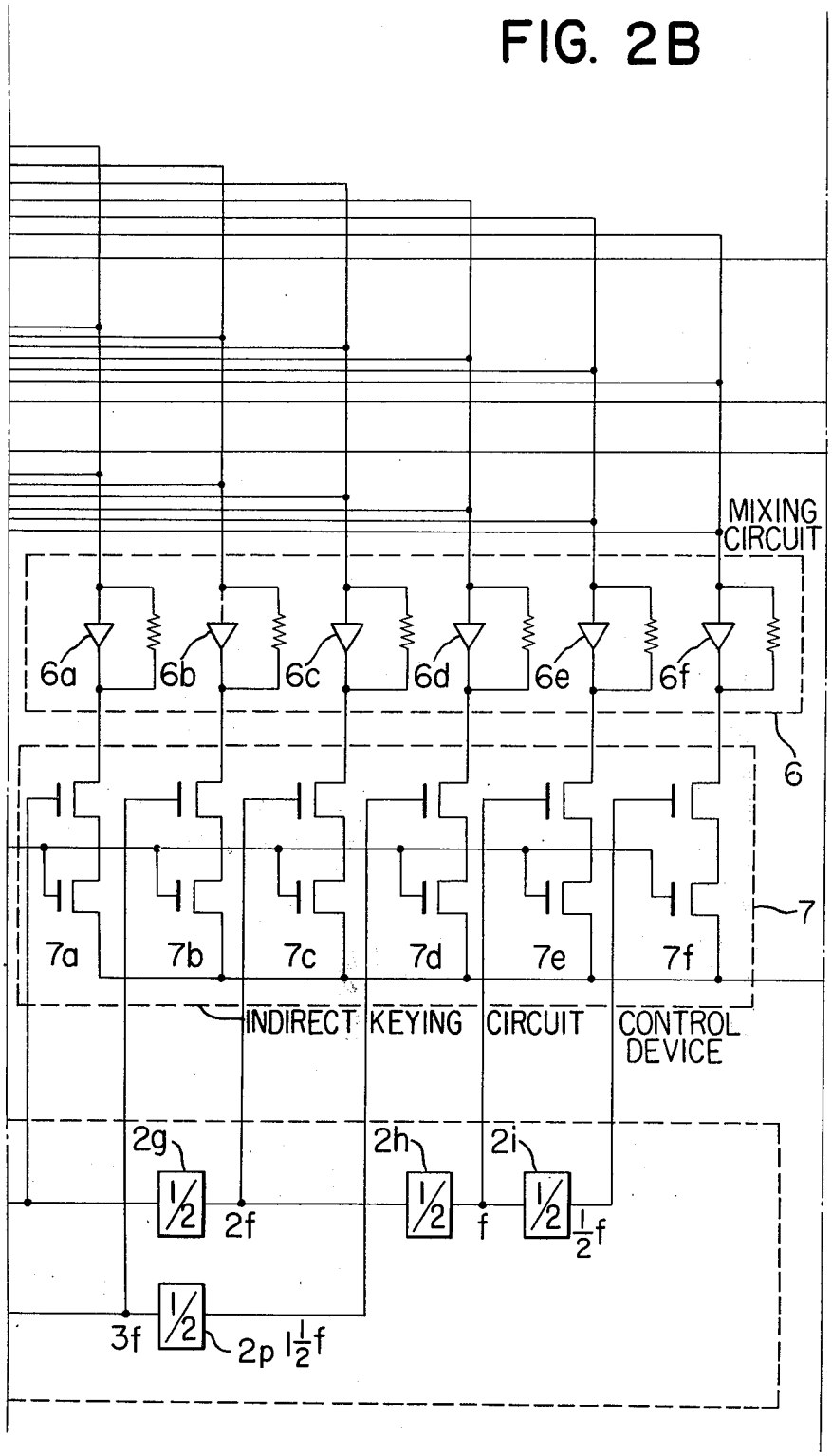

Referring to FIGS. 1 and 2, reference numeral 1 designates generators for producing the notes C through B in the top octave in the equally tempered scale; 2, frequency dividers; 3, a keyboard; 4, switching circuits to be referred to as "tablets" hereinafter in this specification for selecting desired timbres or tone colors; and 5, memory means or bank of resistor arrays for determining the intensity ratio for each tablet to combine the trains of square waveforms with a frequency which is an integral multiple of the basic or fundamental frequency, the resistor arrays 5*a*, 5*b*, . . . 5*n* being different in resistance ratio for the tablets 4*a*, 4*b*, . . . 4*n*, respectively. Reference numeral 6 designates mixing circuits or bank of first operational amplifiers for combining the intensity ratios of tones selected by the selected tablets as will be described in detail hereinafter; 7, indirect keying circuits or waveform synthesizers consisting of MOS-FET groups for forming the basic or fundamental waveform of the tone by intermittently interrupting the rectangular waves from the generators 1 as well as the analog signals from the selected tablets in response to the signals from the keyboard switches 3*a*, 3*b*, . . . 3*n;* 2*a*, ½ frequency dividers; 2*j*, ¼ frequency dividers; and 2*b*–2*e*, 2*g*–2*n* and 2*p*, ½ frequency dividers.

Reference numeral 8 designates mixing circuits or second operational amplifiers for combining the tone signals for each octave produced by synthesizing the square waveforms specific to the selected tablets as will be described in detail hereinafter; 9, variable filters in which the pass bands are varied by electronic switches so that the outputs from the second operational amplifiers 8 may contain only desired harmonics; 14, special effects circuits; 10, filter control circuit for controlling the variable filters 9 in response to the output from the selected tablets; 15, an audio amplifier; 16, a speaker; 11, a detector for detecting the number of pressed keys or a detector of key number so as to control the voltages to be applied to the tablets depending upon the number of pressed keys; 12, a detector for detecting the number of selected tablets or a detector of tablet number so as to control the voltages to be applied to tablets depending upon the number of selected tablets; 13, a variable reference voltage source for generating a reference voltage to be applied to the tablets 4 in response to both outputs from the detectors 11 and 12; and 18, a device for effecting the envelop control such as sustain effect.

Next the mode of operation will be described. The C note output from the generator 1 is divided by the frequency dividers 2 into the rectangular waveforms with frequencies *f*, ½*f*, 2*f*, 3*f* and 4*f*. In like manner, the outputs C sharp through B from the generators 1 are divided by the frequency dividers 2 into the rectangular waveforms.

In the MOS-FET group 7, the rectangular waveform tone signal with the frequency 4*f* is applied to the gate of a first transistor of a transistor pair 7*a*, and a DC voltage from a DC voltage source 17 is applied to the gate of the other or second transistor when the keyboard 3 is pressed. Therefore, the transistor pair 7*a* intermittently interrupts the analog signal from the operational amplifier 6*a* at the frequency 4*f* when the note "$C_2$" key switch 3*a* is pressed. In like manner, a transistor-pair 7*b* intermittently interrupts the analog signal from the operational amplifier 6*b* in response to the rectangular waveform with the frequency 3*f* when the $C_2$ key is pressed. In like manner, transistor pairs 7*c*–7*f* intermittently interrupt the outputs from the operational amplifiers 6*c*–6*f*. Even though only the output from the $C_2$ key is shown in FIG. 2, the output from each note key in each octave is also connected to the gate of the second transistor in the other MOS-FET group. For instance when the "$C_3$" key is pressed, the output from the operational amplifier 6*a* is intermittently interrupted in response to the output from the frequency divider 2*d;* that is, the rectangular waveforms of the next higher octave. In like manner, the output from the operational amplifier 6*b* is intermittently interrupted in response to the output from the frequency divider 2*m*.

Figure 3:
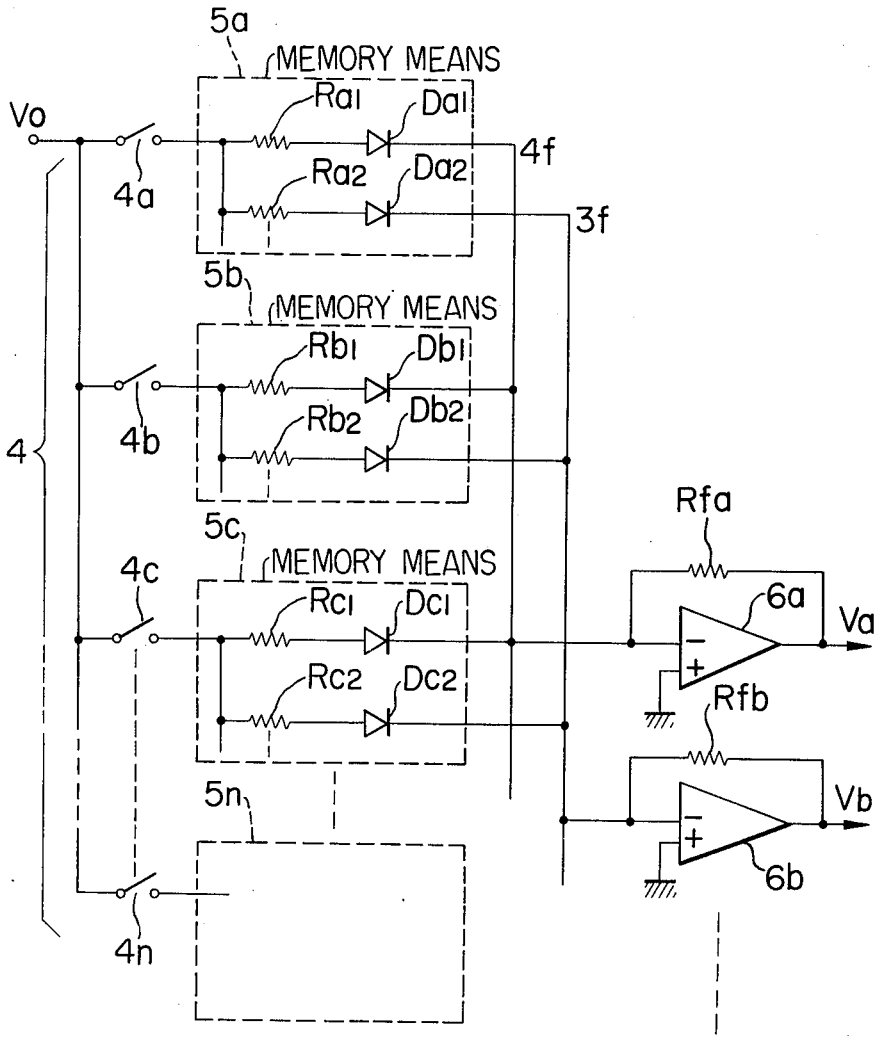
FIG. 3 is a circuit diagram of tablet switches and a waveform memory circuit.

Referring to FIG. 3, the tablet group 4 includes a plurality of tablets 4*a*, 4*b*, . . . 4*n*, and when the tablet 4*a* is closed, the output voltage $V_o$ from the variable reference voltage source 13 (See FIGS. 1 and 2) is applied to the resistor array 5*a*. The resistance ratio among the resistor arrays 5*a*, 5*b*, . . . 5*n* is so selected that the mixing ratio of the rectangular waveforms with the frequencies 4*f*, 3*f*, 2*f*, 3/2*f*, *f* and *f*/2 may be determined in response to the tone quality or timbre selected by the tablets 4*a*, 4*b*, . . . 4*n*. For instance, in the resistor array 5*a*.

$$Ra_1 : Ra_2 = 2 : 1 \tag{1}$$

Therefore when only the tablet 4*a* is closed, $$\frac{Vo}{Ra_1} = -\frac{Va}{Rfa} \tag{2}$$

$$\frac{Vo}{Ra_2} = -\frac{Vb}{Rfb} \tag{3}$$

where the voltage drops across the diodes $Da_1$ and $Da_2$ inserted for the purpose of preventing the reverse current flow are disregarded. Therefore the ratio between the output voltages V*a* and V*b* from the first operational amplifiers 6*a* and 6*b* is $$Va : Vb = 1 : 2 \tag{4}$$

if $Rfa = Rfb$.

Therefore, the step wave in which the rectangular waveforms with the frequencies 4*f* and 3*f* are mixed in the ratio of 1 to 2 appears at the input terminal $C_2$ of the second operational amplifier 8*a* corresponding to the $C_2$ note key (See FIG. 2).

When three tablets 4*a*, 4*b* and 4*c* are pressed simultaneously, the output voltage from the operational amplifier 6*a* is given by $$Va = -Rfa \cdot Vo \left(\frac{1}{Ra_1} + \frac{1}{Rb_1} + \frac{1}{Rc_1}\right) \tag{5}$$

From Eq. (5) it is seen that the outputs from the tablets 4*a*, 4*b* and 4*c* are added. Same is true for the operational amplifiers 6*b* – 6*f*. That is, $$Vb = -Rfb \cdot Vo \left(\frac{1}{Ra_2} + \frac{1}{Rb_2} + \frac{1}{Rc_2}\right) \tag{6}$$

$$Vc = -Rfc \cdot Vo \left(\frac{1}{Ra_3} + \frac{1}{Rb_3} + \frac{1}{Rc_3}\right) \tag{7}$$

$$Vd = -Rfd \cdot Vo \left(\frac{1}{Ra_4} + \frac{1}{Rb_4} + \frac{1}{Rc_4}\right) \tag{8}$$

$$Ve = -Rfe \cdot Vo \left(\frac{1}{Ra_5} + \frac{1}{Rb_5} + \frac{1}{Rc_5}\right) \tag{9}$$

$$Vf = -Rff \cdot Vo \left(\frac{1}{Ra_6} + \frac{1}{Rb_6} + \frac{1}{Rc_6}\right) \tag{10}$$

where $Rfa = Rfb = \ldots = Rff$.

The ON resistance Ron of each FET of the transistor pairs 7*a* – 7*f* is the operational resistance for combining the rectangular waveforms whose fundamental spectrum is a harmonic. The output from, for instance, the operational amplifier 8*a* V8*a* is given by $$V8a = -\frac{Rf}{Ron}(Va+Vb+Vc+Vd+Ve+Vf) \tag{11}$$

where only the $C_2$ note key is pressed.

As described above, the synthesis ratio is determined by the resistance ratios of the resistor arrays 5*a*, 5*b*, . . . 5*n* for the tablets 4*a*, 4*b*, . . . 4*n* from Eqs. (5) – (11), and the rectangular waveform whose fundamental spectrum is a harmonic is synthesized as the sum of the voltages, and appears at the output of the operational amplifier 8 as the step wave making up the single note signal selected by the keyboard. The addition is carried out by the operational amplifier 8*a* when the C sharp$_2$, $D_2$, . . . $B_2$ note keys are pressed simultaneously.

In summary, the operational amplifier 8*a* accomplishes the addition of the tone signal made up of the rectangular waveforms of one octave from $C_2$ to $B_2$. In this case, the ON resistance Ron of FET is the operational resistance for the addition of the analog signals of notes in each octave. In like manner, the operational amplifier 8*b* accomplishes the addition for one octave from $C_3$ to $B_3$. Same is true for other operational amplifiers 8.

The output tone signals from the operational amplifiers 8 are made to pass through the filters 9*a*, 9*b*, . . . in the variable filter group 9 so that the undesired harmonic components are removed. Thus the tone signals contain only the desired harmonic components.

Figure 5:
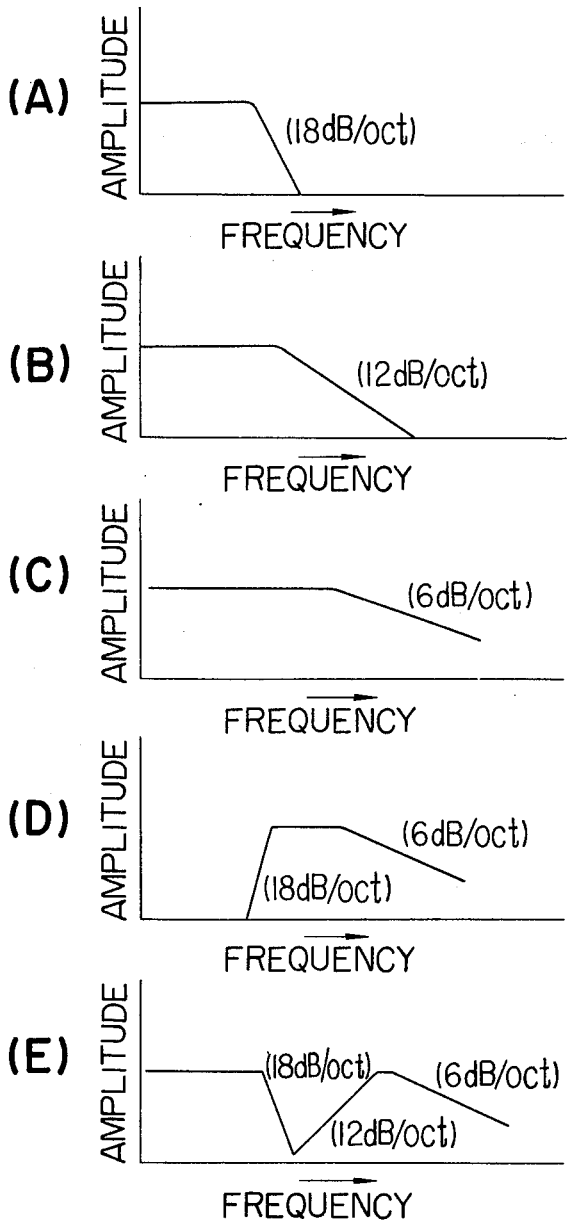
FIG. 5 shows the characteristics of the variable filter shown in FIG. 4.

The electronic organs are designed based upon the pipe organs so that tens of tone qualities or timbres may be produced. However, they may be generally divided into five kinds based upon the harmonic components. Therefore according to the instant embodiment, five filter characteristics as shown at (A) – (E) in FIG. 5 are provided, and are switched electronically in response to the selection of the tablets.

Figure 4:
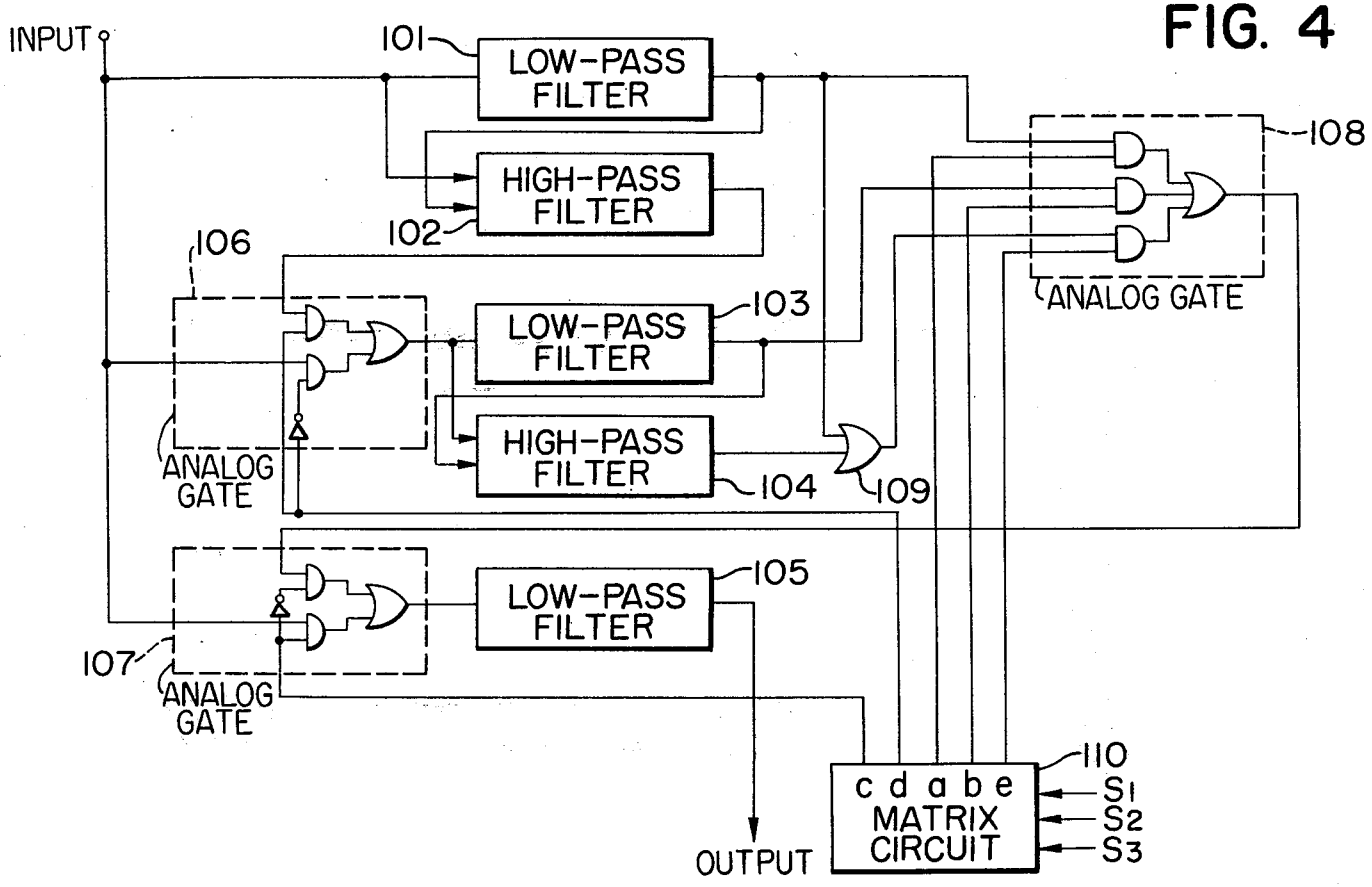
FIG. 4 is a block diagram of one example of an electronically variable filter.

One example of the variable filter is shown in FIG. 4. In FIG. 4, 101 denotes a low-pass filter (LPF1) with the 18 dB/oct. characteristic as shown in FIG. 5(A); 102, a high-pass filter (HPF1) whose characteristic is opposite to that of the low-pass filter LPF1 101 in the low and high frequency range, and to which is negatively fed back by the output from LPF1 101; 103, a low-pass filter LPF2 with the characteristic of 12 dB/oct. as shown in FIG. 5(B); 104, a high-pass filter HPF2 whose characteristic is opposite to that of LPF2 103 in the high and low frequency ranges and which is negatively fed back by the output from LPF2 103; 105, a low-pass filter LPF3 with the characteristic of 6 dB/oct. as shown in FIG. 5(C); and 106, 107, 108 and 109, analog gates for switching the outputs from the filters. Numeral 110 denotes a matrix circuit one of the outputs *a*, *b*, *c*, *d* and *e* of which rises to 1 level in response to the selection of the tablets 4*a*, 4*b*, . . . 4*n*. Therefore, in response to the input signals $S_1$, $S_2$, $S_3$ to the matrix circuit 110, one of the filter characteristics shown in FIG. 5(A), (B), (C), (D) and (E) is electronically selected. The input signals $S_1$, $S_2$, $S_3$ represent the 4.2.1 coded signal which in turn represents the selected tablet. For each octave the variable filters 9*a*, 9*b*, . . . have their cutoff frequencies varied so that the filter characteristics for tablets 4*a*, 4*b*, . . . 4*n* may be provided for all octaves.

The outputs from the filter group 9 are combined into the output for the upper keys and the output for the lower keys, which are applied through the special effects circuits 14U and 14L, respectively, to the audio amplifier 15 so that they are converted into sounds by the speaker.

Figure 6:
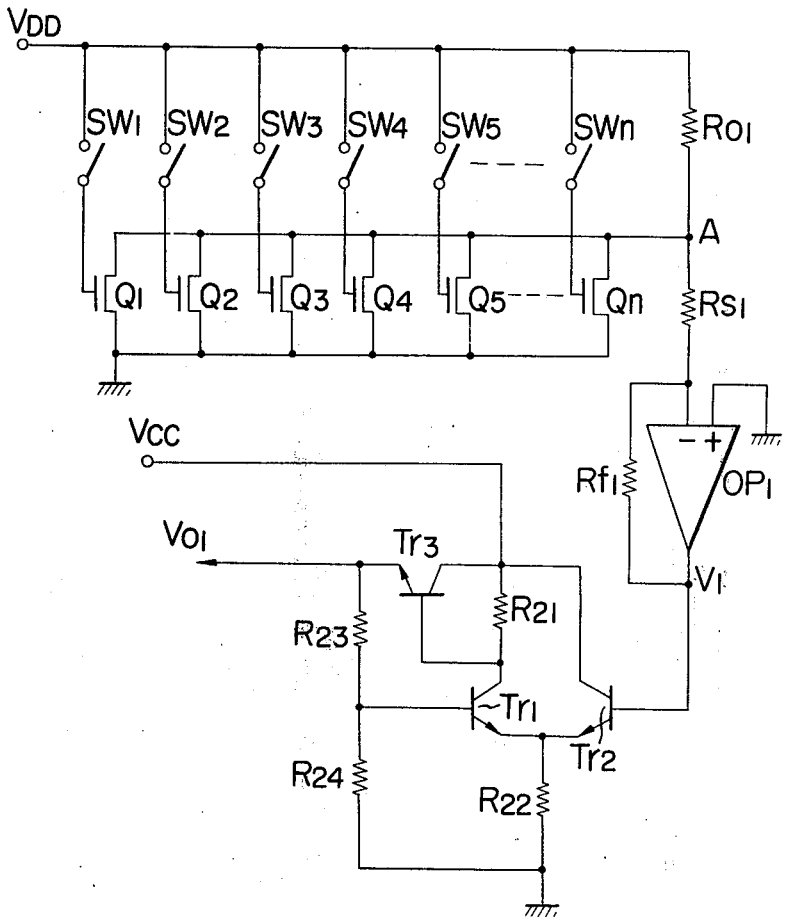
FIG. 6 is a circuit diagram of a detector of key number and a variable reference voltage source.

Next the circuits 11, 12 and 13 will be described. FIG. 6 is a circuit diagram of the detector 11 and the variable reference voltage source 13. $SW_1$, $SW_2$, . . . $SW_n$ are key switches; $Q_1$, $Q_2$, . . . $Q_n$, are MOS-FETs whose ON resistance is equal; $Ro_1$ is a dividing resistance; $Rs_1$, a series resistance; $Rf_1$, a feedback resistor; $OP_1$, an operational amplifier. Let ON resistance of MOS-FETs $Q_1$, $Q_2$, . . . $Q_n$ be Ron and assume that the number of *n* key switches are pressed. Then the voltage at the point A is $$V_A = \frac{Ron}{Ron + n\,R_{01}} V_{DD} \qquad (12)$$

$Rs_1$ is sufficiently grater than Ron and $Ro_1$. Therefore the output $V_1$ of the operational amplifier $OP_1$ is given by $$V_1 = \frac{Rf_1\,Ron}{Rs_1\,(Ron + nRo_1)} V_{DD} \qquad (13)$$

The greater the number of keys, the lower $V_1$ becomes. The variable reference voltage source consisting of transistors $Tr_1$ to $Tr_3$ and resistors $R_{21}$ to $R_{24}$ is so arranged as to exhibit the linear input-output characteristic curve. Then the output voltage $Vo_1$ from the variable reference voltage source is given by $$Vo_1 = a_1 \cdot V_{DD} \cdot V_{CC} \cdot \frac{Rf_1 \cdot Ron}{Rs_1\,(Ron + n\,Ro_1)} \qquad (14)$$

The output $Vo_1$ exhibits the characteristic similar to that the output $V_1$. In equation (14), $a_1$ is a gain. Eq. (14) is indicated by the Vo characteristic curve in FIG. 7. In this graph, $Ron/Ro_1$ is equal to 2, and output voltage is 1 when *n* is 1.

Figure 7:
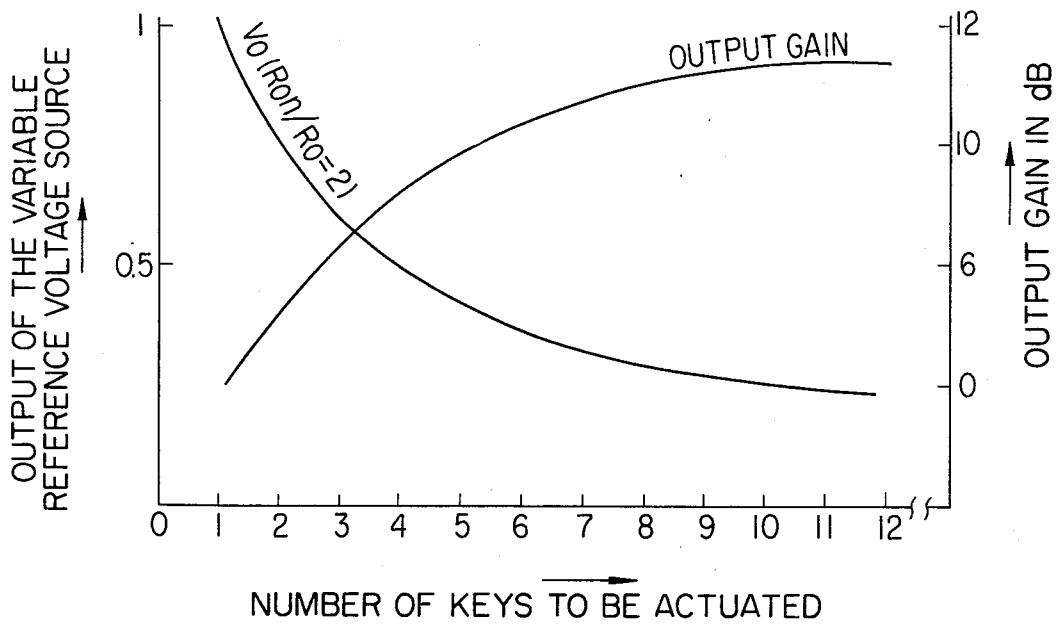
FIG. 7 shows the output gain characteristic curve obtained by the circuit shown in FIG. 6.

Assume that the voltage applied to the tablet group 4 is constant because it is not controlled by the detector and that the amplification degree of the audio amplifier 15 be linear up to a sufficiently high signal level. Then the output tone signal level is increased in proportion to the number of keys pressed, but when the detector is used, the output gain characteristic as shown in FIG. 7 may be obtained. It is more natural for tone quality or timbre that the output shows the tendency of saturation as shown in FIG. 7 as the number of keys pressed is increased rather than that the output is increased. The detector of tablet number is similar in construction and mode of operation to the detector of key number, but the detector of tablet number detects the number of tablets selected instead of the keys pressed.

Figure 8:
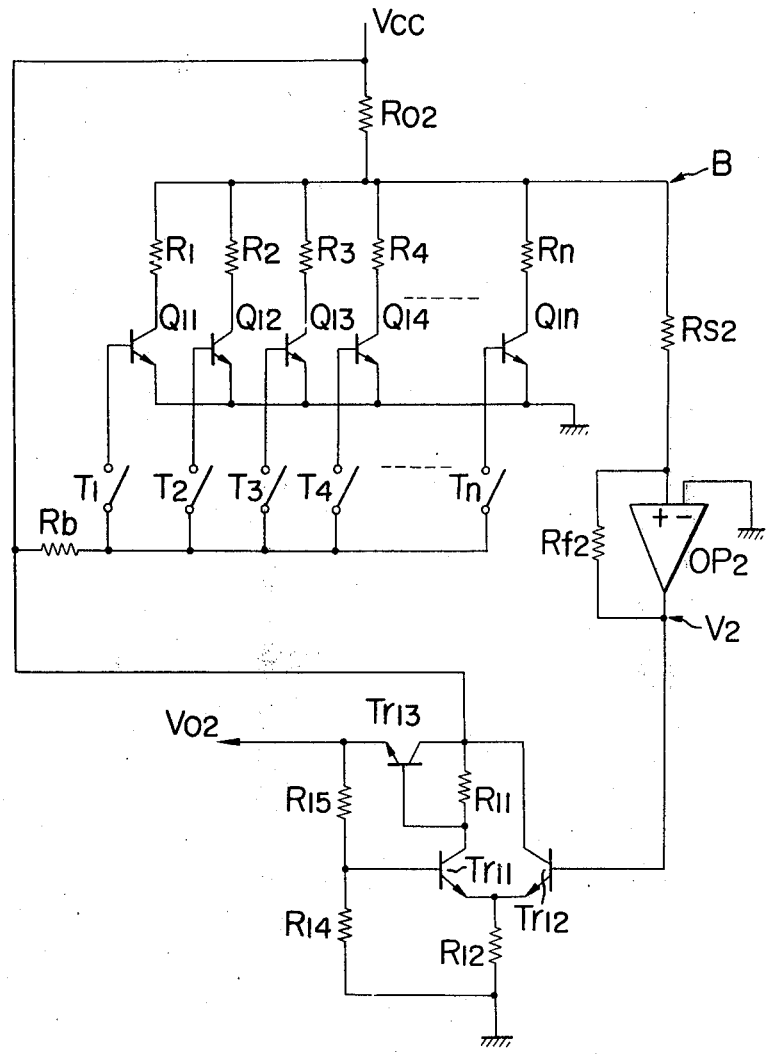
FIG. 8 is a circuit diagram of a detector of tablet number and a variable reference voltage source.

FIG. 8 is a diagram of the detector of tablet number 12 and the variable reference source 13. $T_1$, $T_2$, . . . $T_n$ are tablet switches; $Q_{11}$, $Q_{12}$, . . . $Q_{1n}$ are NPN transistors with a small saturation resistance; $Ro_2$, a voltage dividing resistor; $Rs_2$, a series resistor; $Rf_2$, a feedback resistor; and $OP_2$, an operational amplifier. $R_1$, $R_2$, . . . $R_n$ have the same value or different values. When $Rt = R_1 = R_2 = \ldots = R_n$ and *m* tablets are selected, the voltage at point B is given by $$V_B = \frac{Rt}{Rt + mRO_2} V_{CC} \qquad (12)\text{-}2$$

if $Rs_1$ is sufficiently higher than *Rt* and $Ro_2$. The output of the operational amplifier $OP_2$ is given by $$V_2 = \frac{Rf_2 \cdot Rt}{} \qquad (13)\text{-}2$$

-continued $$Rs_2\,(Rt + mRo_2)$$

The larger the number of tablets selected, the greater $m$ becomes while the lower $V_2$ becomes.

When the variable reference voltage source consisting of transistors $Tr_{11}$ to $Tr_{13}$ and resistors $R_{11}$ to $R_{14}$ is so arranged as to exhibit the linear input-output characteristic, the output voltage $Vo_2$ is given by $$Vo_2 = a_2 \cdot V^2_{CC} \cdot \frac{Rf_2}{Rs_2} \cdot \frac{Rt}{Rt + mRo_2} \qquad (14)\text{-}2$$

Figure 9:
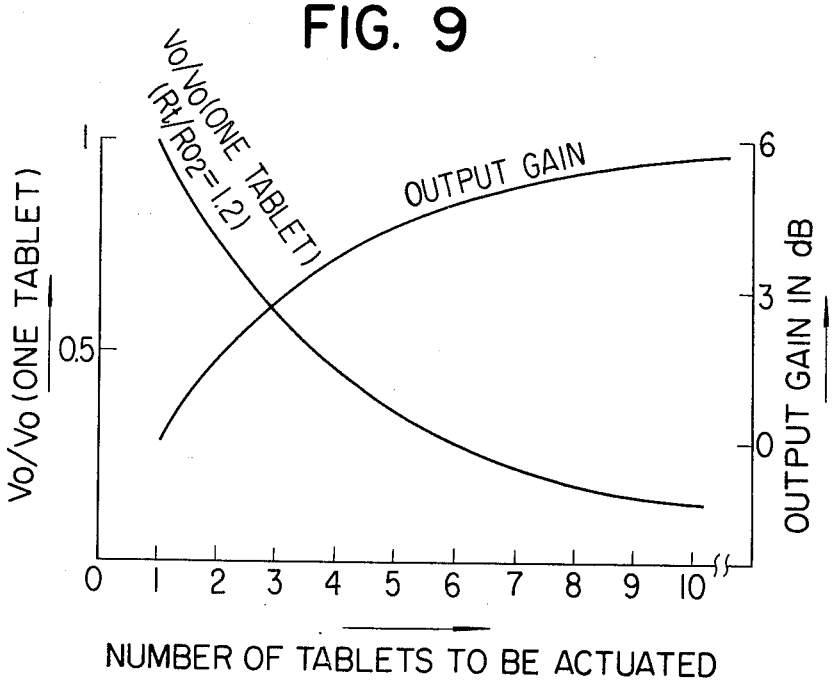
FIG. 9 shows the output gain characteristic curve obtained by the circuit shown in FIG. 8.

This is shown in FIG. 9, and $a_2$ is a gain. The characteristic curve $Vo_2/Vo_2$(when only one tablet is selected) shown in FIG. 9 is obtained and $Rt/Ro_2 = 1.2$.

When the number of keys pressed is constant and the detector of tablet number with the above construction is used, the output tone signal characteristic curve as shown in FIG. 9 is obtained. It is more natural for tone color or timbre that as the number of tablets selected is increased, the output exhibits the saturation tendency as shown in FIG. 9 rather than it increases. So far $R_1 = R_2 = \ldots = R_n$, but the resistors may have different values; that is, $R_1 \neq R_2 \neq \ldots \neq R_n$. Thus the fine control on the addition between tablets may be attained.

Figure 10:
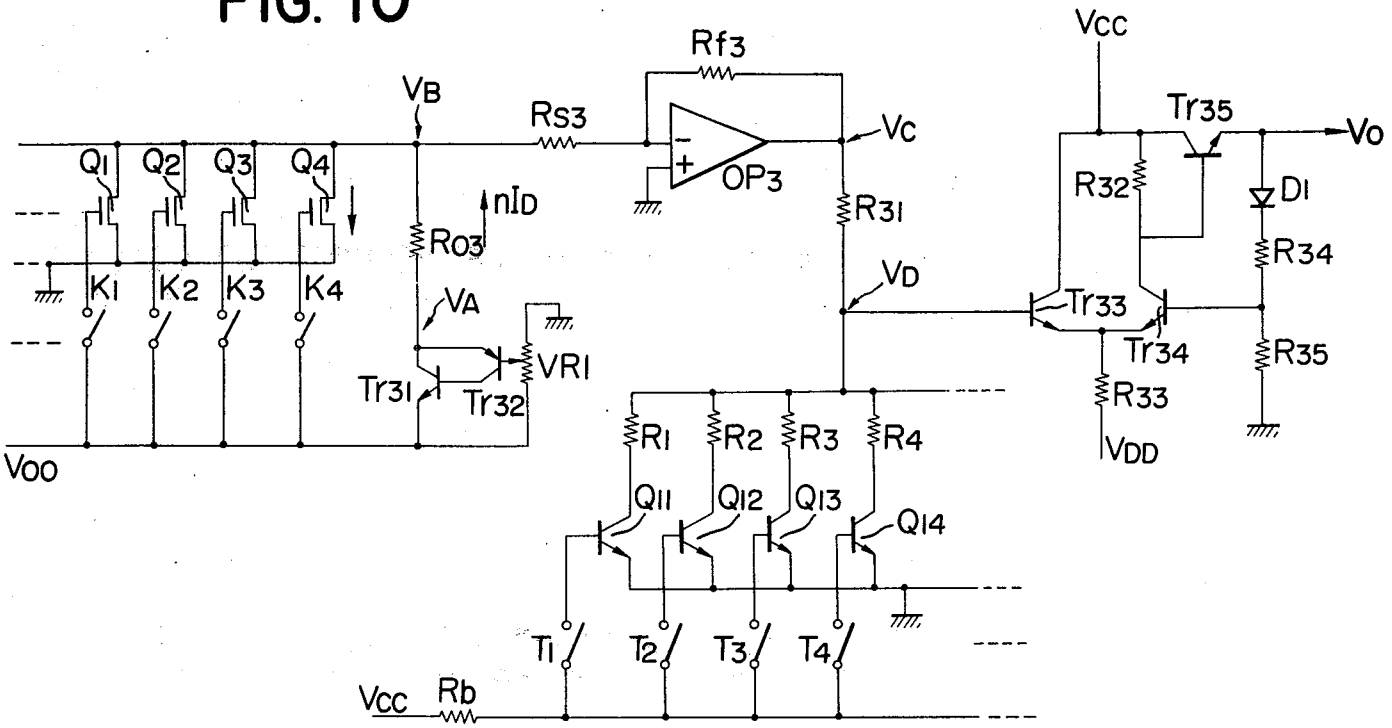
FIG. 10 is a circuit diagram of an arrangement in which both a detector of key number and a detector of tablet number are provided and a variable reference voltage source which is controlled in response to the outputs from said two detectors is also provided.

Next the mode of controlling the tone signal when both the number of keys pressed and the number of tablets selected are detected will be described. Referring to FIG. 10, $K_1$, $K_2$, . . . are key switches; $Q_1$, $Q_2$, . . . are MOS-FETs whose ON resistance is equal; $Ro_3$ is a voltage dividing resistor; $Rs_3$ is a series resistor; $Rf_3$ is a feedback resistor; and $OP_3$ is an operational amplifier; $T_1$, $T_2$, . . . are tablet switches; $Q_{11}$, $Q_{12}$, . . . are transistors or switching elements; $R_1$, $R_2$, . . . are resistors whose value are equal or different; $R_{31}$ is a voltage division resistor; and $Tr_{33}$, $Tr_{34}$, $Tr_{35}$, $R_{32}$, $R_{33}$, $R_{34}$, $R_{35}$ and $D_1$ make up a voltage source.

Next the mode of operation will be described. First we consider the state where MOS-FETs $Q_1$, $Q_2$, . . . are not saturated; that is, $V_B < V_{DD} - V_T$, where $V_T$ = threshold voltage, and the body effect is disregarded. When $n$ keys are pressed, the number of MOS-FETs which are turned on is also $n$. Let the current flowing through one MOS-FET be $I_D$, then the following relations are held between $V_A$ and $V_B$:

$$I_D = -\beta[V_{DD} - V_T)V_B - \tfrac{1}{2} V_B^2] \qquad (15)$$

$$V_A - V_B = n.I_D.Ro_3 \qquad (16)$$

where $$\beta = \frac{W}{L} \cdot \frac{\epsilon_{ox}}{t_{ox}} \cdot \mu \qquad (17)$$

where $\epsilon_{ox}$ = permittivity of oxide,
$t_{ox}$ = thickness of oxide over channel,
$\mu$ = average surface mobility in channel,
$W$ = width of channel, and
$L$ = length of channel.

It was assumed $R_8 >> Ro_3$, and the current flowing through $R_5$ is disregarded.

Figure 11:
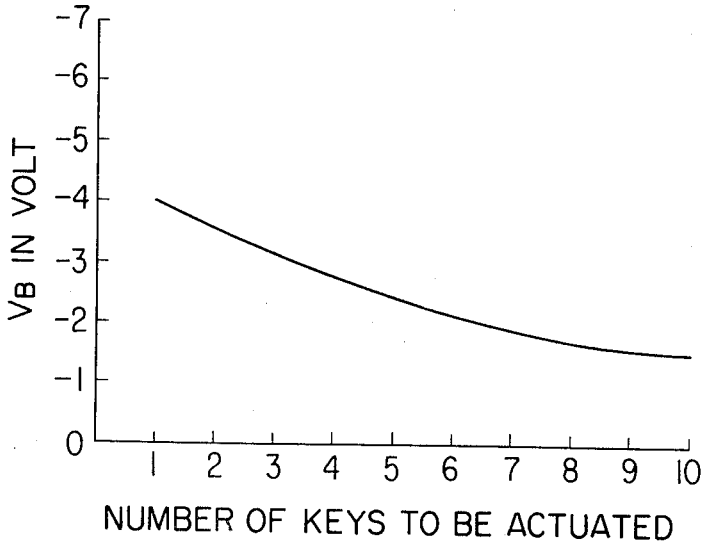
FIG. 11 is a diagram illustrating the voltage at the point $V_B$ in the circuit shown in FIG. 10.

When $V_A$ and $V_{DD}$ are maintained constant, the relation between the number of keys pressed $n$ and $V_B$ is obtained as shown in FIG. 11 from Eqs. (15) and (16). The DC voltage $V_B$ is reversed in polarity and amplified by the operational amplifier $OP_3$ so that output $V_C$ is obtained. The relation between $n$ and $V_C$ is similar to that of $V_B$ described above.

When $m$ tablets are selected and the saturation resistance VCE (SAT) between the collector and emitter of transistor $Q_{11}$ is disregarded.

$$V_D = \frac{Rt}{Rt + mR_{31}} \cdot V_C \qquad (18)$$

if $Rt = R_1 = R_2 = \ldots$

Figure 12:
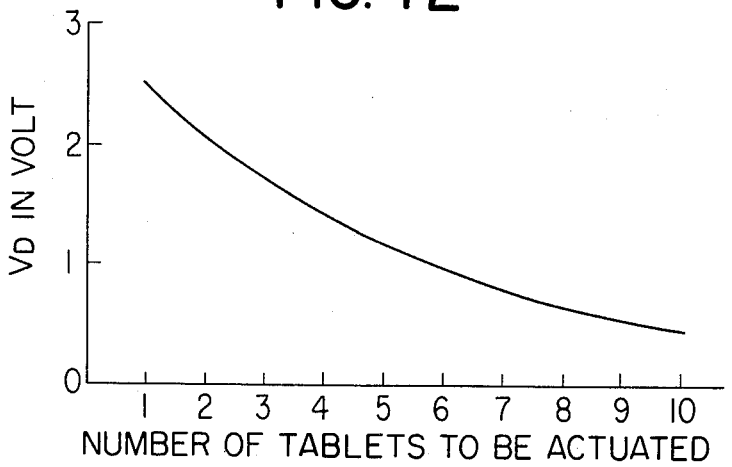
FIG. 12 is a diagram illustrating the voltage at the point $V_D$ in the circuit shown in FIG. 10.

Therefore when $V_C$ is maintained constant, the relation between $m$ and $V_D$ is obtained as shown in FIG. 12. $V_D$ is amplified by the variable reference voltage source consisting of $Tr_{33}$ to $Tr_{35}$, $R_{32}$ to $R_{35}$ and $D_1$, and the output voltage Vo is given by $$Vo = \frac{R_{34} + R_{36}}{R_{35}} V_D + V_{D1} \qquad (19)$$

where $V_{D1}$ is a forward voltage drop across diode $D_1$. The output voltage Vo is connected to Vo shown in FIG. 3.

The output voltage is increased $V_{D1}$ in order to compensate the voltage drops across diodes $Da_1$, $Da_2$, . . . shown in FIG. 2. When the diodes with substantially similar characteristics are used as $Da_1$, $Da_2$, . . . the voltage variation including the variation due to the temperature variation may be absorbed.

Figure 13:
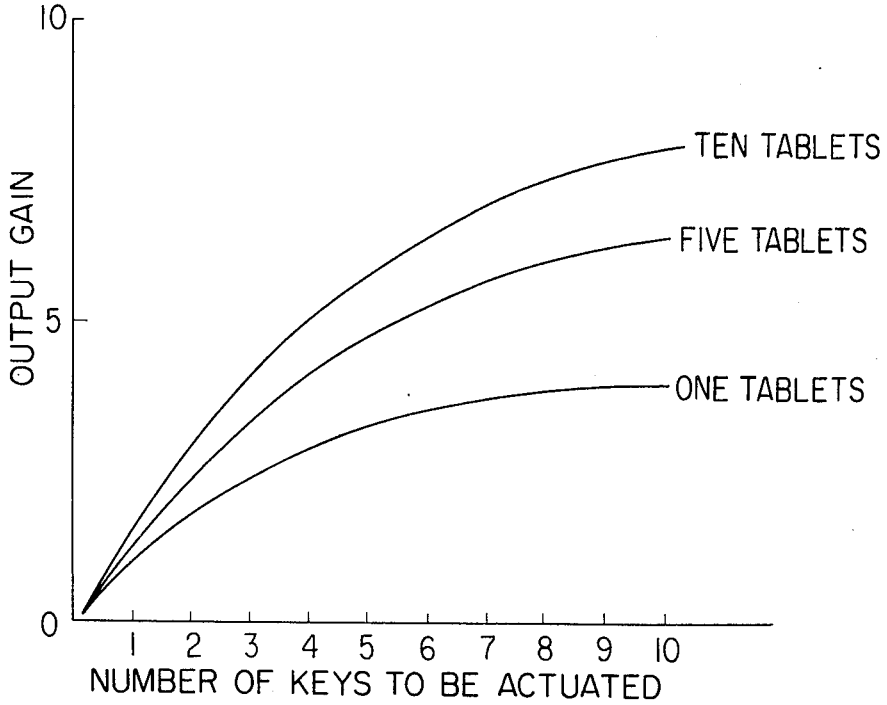
FIG. 13 shows the output gain characteristic curve obtained by the circuit shown in FIG. 10.
Figure 14:
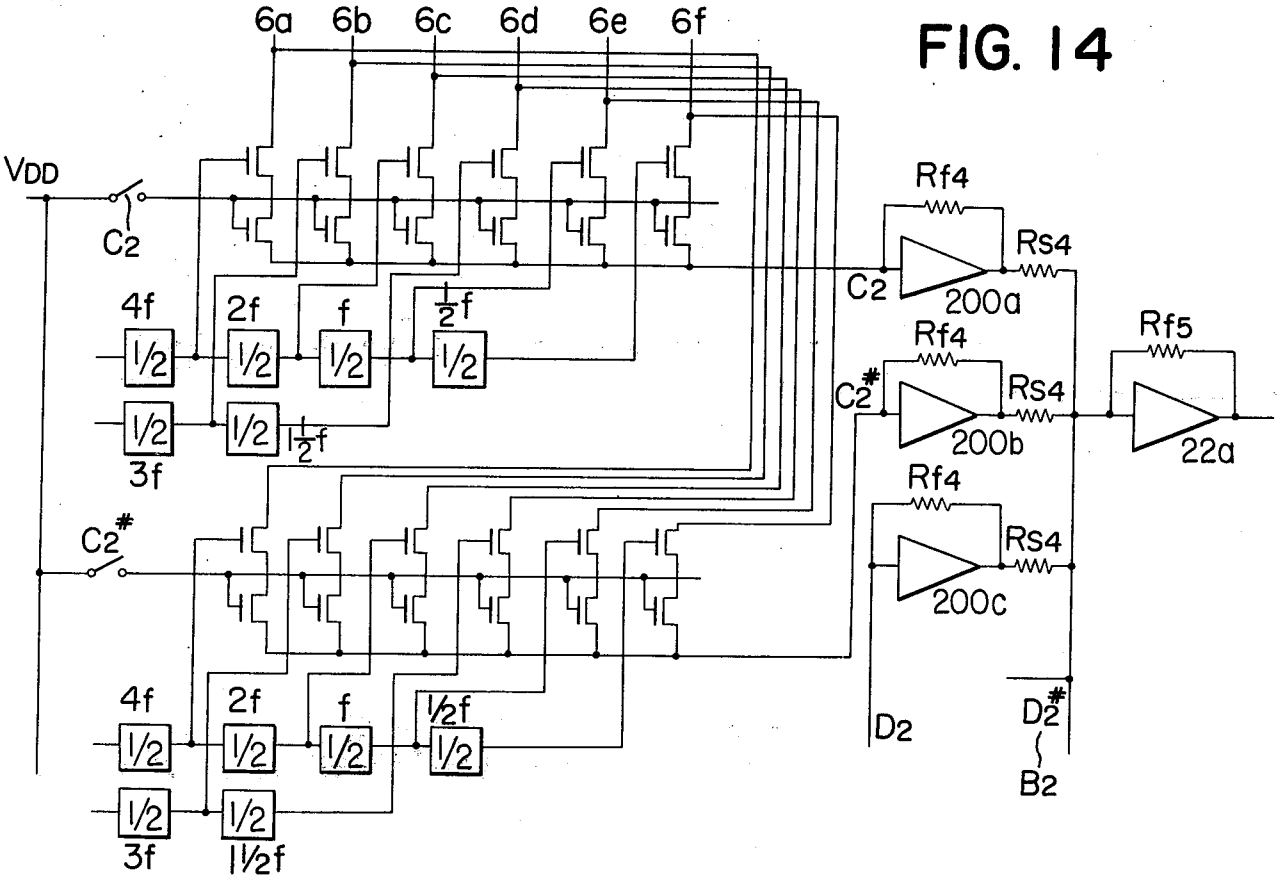
FIG. 14 is a circuit diagram illustrating an example in which the synthesis for each scale and for each octave are accomplished in two steps in a mixing circuit 8 shown in FIG. 1.

When the voltage applied to the tablet group 4 is not controlled by the detectors of key number and tablet number and is maintained at a constant level, and if the audio amplifier 15 exhibits the linear amplification degree up to a sufficiently high signal level, the output tone signal level increases in proportion to the number of keys pressed and to the number of tablets selected. But when the detectors of the type described above are used, $vo$ is gradually decreased as shown in FIG. 13. Thus by the detection of the number of keys pressed and the number of tablets selected, the output tone signal with the tendency of being saturated in a predetermined manner may be produced.

The saturation characteristic may bse arbitarily varied by changing the voltage division resistors $Ro_3$ and $R_{31}$.

What is claimed is:

1. An electronic organ comprising a. a reference voltage source, b. at least one group of tablets for selectively passing the current from said reference source, c. at least one group of memory means for separating the current which has passed through each of said tablets into a plurality of currents each with a predetermined different magnitude with respect to each other, d. at least one group of first means for mixing selected currents from said memory means, e. means for generating top octave waves, f. a plurality of groups of means for dividing stepwise the frequency of the waves of each interval of said top octave waves, g. a DC voltage source, h. at least one keyboard consisting of keys for selectively passing the voltage from said DC voltage source, i. a plurality of indirect keying means each for modulating the current from each of said mixing means by the frequency-divided waves and selectively passing the modulated waves in response to the operation of each of said keys of said keyboard, and j. at least one means for converting the waves of said indirect keying means into the musical sounds.

2. An electronic organ as set forth in claim 1 further comprising at least one group of second mixing circuits inserted between said indirect keying means and said means for converting the waves from said indirect keying means into the musical sounds for mixing the modulated waves from said indirect keying means for each octave.

3. An electronic organ as set forth in claim 2 further comprising at least one group of variable filter means inserted between said second mixing circuits and said means for converting the waves from said indirect keying means into the musical sounds for transmitting only the desired higher harmonics of the mixed modulated waves in response to the selection of said tablets; and at least one filter control circuit for controlling said variable filter means in response to the selection of said tablets.

4. An electronic organ as set forth in claim 2 wherein each of said second mixing circuits comprises an operational amplifier.

5. An electronic organ as set forth in claim 3 further comprising at least one special effects circuit means inserted between said group of said variable filter means and said means for converting the waves into the musical sounds.

6. An electronic organ as set forth in claim 3 wherein each of said variable filter means has a different frequency characteristics.

7. An electronic organ as set forth in claim 1 further comprising tablet number detecting means for controlling said reference voltage source in response to the number of selected tablets.

8. An electronic organ as set forth in claim 7 wherein said tablet number detecting means comprises a circuit consisting of npn transistors connected in parallel, the voltages from each selected tablet being applied as the control input to said npn transistors; and an operational amplifier to which is applied the output of said parallel circuit as the input.

9. An electronic organ as set forth in claim 1 further comprising key number detecting means for controlling said reference voltage in response to the number of pressed keys.

10. An electronic organ as set forth in claim 9 wherein said key number detecting means comprises a parallel circuit of MOS-FETs to which are impressed the voltages from key switches as the control input respectively; and an operational amplifier connected in series to said parallel circuit.

11. An electronic organ as set forth in claim 9 wherein said reference voltage source comprises a transistorized differential amplifier, a power transistor to which is applied the output of said differential amplifier as the control input; and resistors for applying the bias voltages to said transistors.

12. An electronic organ as set forth in claim 1 further comprising an envelop control device inserted between a connection of said keys and said indirect keying means and the ground.

13. An electronic organ as set forth in claim 1 wherein each of said memory means comprises a group of series circuits each consisting of a resistor and a diode, said series circuits being connected in parallel to said tablets, said resistors having a different value of resistance.

14. An electronic organ as set forth in claim 1 wherein each of said first mixing means comprises an operational amplifier.

15. An electronic organ as set forth in claim 1 wherein each of said indirect keying means comprises two FET transistors connected in series, the base of one of said two FET transistors being connected to one terminal of said frequency-divided waves, the base of the other FET transistor being connected to each of said keys.

16. An electronic organ as set forth in claim 1 wherein each of said frequency dividing means comprises two series of frequency dividers, the first stage of one of said two series being a ⅓ frequency divider, the first stage of the other series being a ¼ frequency divider, and the remaining stages being ½ frequency dividers.

17. An electronic organ comprising a. a reference voltage source, b. at least one group of tablets for selectively passing the current from said reference source, c. at least one group of memory means for separating the current which has passed through each of said tablets into a plurality of currents each with a predetermined different magnitude, d. at least one group of first means for mixing selected currents from said memory means, e. means for generating top octave waves, f. a plurality of groups of means for dividing stepwise the frequency of the waves of each interval of said top octave waves, g. a DC voltage source, h. at least one keyboard consisting of keys for selectively passing the voltage from said DC voltage source, i. a plurality of indirect keying means each for modulating the current from each of said mixing means by the frequency-divided waves and selectively passing the modulated waves in response to the operation of each of said keys, and j. at least one means for converting the waves from said indirect keying means into the musical sounds;

k. at least one group of second mixing circuits inserted between said indirect keying means and said means for converting the waves from said indirect keying means into the musical sounds for mixing the modulated waves from said indirect keying means for each octave, l. at least one group of variable filter means inserted between said second mixing circuits and said means for converting the waves from said indirect keying means into the musical sounds for transmitting only the desired higher harmonics of the mixed modulated waves in response to the selection of said tablets; and at least one filter control circuit for controlling said variable filter means in response to the selection of said tablets, m. at least one effect circuit means inserted between said group of said variable filter means and said means for converting the waves into the musical sounds, n. tablet number detecting means for controlling said reference voltage source in response to the number of selected tablets, o. key number detecting means for controlling said reference voltage in response to the number of pressed keys; and p. an envelop control device inserted between a connection of said keys and said indirect keying means and the ground.

18. An electronic organ as set forth in claim 17 further comprising a plurality of said tablet groups, a plurality of said memory groups, a plurality of said first mixing means groups, a plurality of said second mixing means groups, a plurality of said variable filter means groups, and a plurality of said effect circuit groups, the numbers of each of said groups being equal to the number of said keyboards, a plurality of frequency dividing means groups equal in number to the intervals of said top octave waves, a plurality of said indirect keying circuit groups, and a plurality of said envelop control circuits, the numbers of each of said two groups being equal to that of said keys.

* * * * *

UNITED STATES PATENT OFFICE

CERTIFICATE OF CORRECTION

Patent No. 3,939,750 Dated February 24, 1976

Inventor(s) Michihiro Inoue, et al

It is certified that error appears in the above-identified patent and that said Letters Patent are hereby corrected as shown below:

Column 6, line 66: Change the formula as follows:

from "$V_2 = \frac{Rf_2Rt}{\quad}$" to --$V_2 = \frac{Rf_2Rt}{Rs_2(Rt + mRo_2)}$--.

Column 7, lines 1 and 2: Cancel the lines in their entirety.

Column 8, line 43: Change "bse" to --be--.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*